US006611111B2

(12) United States Patent
Miyoshi

(10) Patent No.: US 6,611,111 B2
(45) Date of Patent: Aug. 26, 2003

(54) LOAD DRIVE CIRCUIT

(75) Inventor: Kenichi Miyoshi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/060,314

(22) Filed: Feb. 1, 2002

(65) Prior Publication Data

US 2002/0109465 A1 Aug. 15, 2002

(30) Foreign Application Priority Data

Feb. 15, 2001 (JP) ..... 2001-038912

(51) Int. Cl.[7] ..... H05B 37/02

(52) U.S. Cl. ..... 315/224; 315/291; 315/200 R; 315/307; 315/360

(58) Field of Search ..... 315/224, 225, 315/291, 297, 307, 200 R, 360, 362, 363, 292

(56) References Cited

U.S. PATENT DOCUMENTS 5,030,890 A * 7/1991 Johnson ..... 315/208
5,453,667 A * 9/1995 Matsuda et al. ..... 315/248
6,297,569 B1 * 10/2001 Bartels et al. ..... 307/140
6,359,394 B1 * 3/2002 Stein ..... 315/307

* cited by examiner

*Primary Examiner*—Don Wong
*Assistant Examiner*—Tuyet T. Vo
(74) *Attorney, Agent, or Firm*—Finnegan, Henderson, Farabow, Garrett & Dunner, L.L.P.

(57) ABSTRACT

A load drive circuit is disclosed, comprising: a MOSFET 24 including a power supply terminal connected to a lamp load 1, and turned ON/OFF to supply a power supply voltage to the lamp load 1 according to a load driving control signal; a strobe circuit 22 turned ON/OFF according to a monitoring control signal of a timing for monitoring a state of a lamp switch 2; a pull-up resistor 25 connected to the strobe circuit 22; and a microcomputer 21 for driving the lamp load 1 by supplying the load driving control signal to the MOSFET 24 to control turning ON/OFF, and monitoring the state of the lamp switch 2 by supplying the monitoring control signal to the strobe circuit 22 to control turning ON/OFF, based on a voltage value by the pull-up resistor 25.

6 Claims, 3 Drawing Sheets

1
2
3
4
11
21
22
23
24
25
A
b
C
R
a
b
c
d
OFF
ON
SWITCH d
OTHER INPUT SWITCHES 31
CONTROL UNIT
MICROCOMPUTER

HI
LO
ON
OFF
ON
OFF
ON
OFF
ON
OFF
T2
T2
T1
t1
t2
t3
t4
t5
t6
t7
t8

LOAD DRIVE CIRCUIT

BACKGROUND OF THE INVENTION

The present invention relates to a load drive circuit for driving a load circuit, which is controlled to be turned ON/OFF by a switch operated by a user.

A lamp of a direct off switch system directly controlled to be turned ON/OFF by the operation of the user is loaded on an automobile or the like.

FIG. 1 shows a conventional load drive circuit, which drives a lamp load 100 by supplying a power supply voltage from a power supply 101 thereto. This load drive circuit has a constitution in which power supply management for preventing a battery from dying or the like caused by forgetting to turn off of the lamp switch 102 while a lamp switch 102 is kept ON. In the load drive circuit, when the power supply management is performed, a state of the lamp switch 102 disposed on the downstream side of the lamp load 100 seen from the power supply 101 is read by a microcomputer 111 incorporated in a control unit 110, and a relay 112 is controlled by the microcomputer 111 on the upstream side of the lamp load 100 to supply a power supply voltage from the power supply 101 to the lamp load 100.

SUMMARY OF THE INVENTION

However, in the foregoing load drive circuit, if all the circuits can be constructed on the upstream side of the lamp load 100, i.e., on a power supply voltage supply side, the construction of circuitry itself is highly efficient. However, since it is necessary to connect the lamp switch 102 with the microcomputer 111, and monitor an ON/OFF state of the lamp switch 102, overall constitutional efficiency is not so high.

In addition, since another circuit must be added to monitor the state of the lamp switch 102 by the microcomputer 111, costs are increased correspondingly.

The present invention was proposed in consideration of the above-described problems, and it is an object of the invention to provide a load drive circuit capable of driving a load circuit and monitoring an ON/OFF state of the load circuit by simple circuitry.

To achieve the foregoing object, in accordance with an aspect of the invention, a load drive circuit is provided, which is disposed on a downstream side of a power supply to supply a power supply voltage to a load circuit, and adapted to monitor a state of a load power supply switch disposed on a downstream side of the power supply of the load circuit. This load drive circuit comprises: a semiconductor switching device including a power supply terminal connected to the load circuit, and turned ON/OFF to supply a power supply voltage to the load circuit according to a load driving control signal; a monitoring switch circuit turned ON/OFF according to a monitoring control signal of a timing for monitoring the state of the load power supply switch; a monitoring resistor connected to the monitoring switch circuit; and controller for driving the load circuit by supplying the load driving control signal to the semiconductor switching device to control turning ON/OFF, and monitoring the state of the load power supply switch by supplying the monitoring control signal to the monitoring switch circuit to control turning ON/OFF, based on a voltage value by the monitoring resistor.

According to the first aspect, since the load power supply switch is operated to supply the power supply voltage to the load circuit, the semiconductor switching device is driven. Also, the monitoring switch circuit is driven to monitor the state of the load power supply switch operated to turn ON/OFF the load circuit. Thus, in the load drive circuit, supply of the power supply voltage to the load circuit is controlled by the voltage value of the monitoring resistor.

In accordance with a second aspect of the invention, the controller desirably sets supply time of the load driving control signal supplied to the semiconductor switching device to be sufficiently shorter than supply time of the monitoring control signal supplied to the monitoring switch circuit.

According to the second aspect, a period of monitoring the load power supply switch by the monitoring control signal is set to be shorter than a period of driving the load circuit by the load driving control signal.

In accordance with a third aspect of the invention, the controller desirably turns OFF the semiconductor switching device during driving of the load circuit, and turns ON said monitoring switch circuit to monitor the state of the load power supply switch while turning OFF the semiconductor switching device.

According to the third aspect, while the load power supply switch is ON to drive the load circuit, the semiconductor switching device is first turned OFF, and the state of the load power supply switch is monitored within this period.

In accordance with a fourth aspect of the invention, the load circuit may be a lamp load.

According to the fourth aspect, the semiconductor switching device is driven to supply a power supply voltage to the lamp load, and the monitoring switch circuit is driven to monitor the state of the load power supply switch operated to turn ON/OFF the lamp load.

BRIEF DESCRIPTION OF THE DRAWINGS

FIG. 3A showing a potential at a node A; FIG. 3B a MOSFET; 3C a strobe circuit; 3D a lamp switch; and 3E a lamp load.

DESCRIPTION OF THE PREFERRED EMBODIMENT

Next, the preferred embodiment of the present invention will be described with reference to the accompanying drawings.

Figure 1:
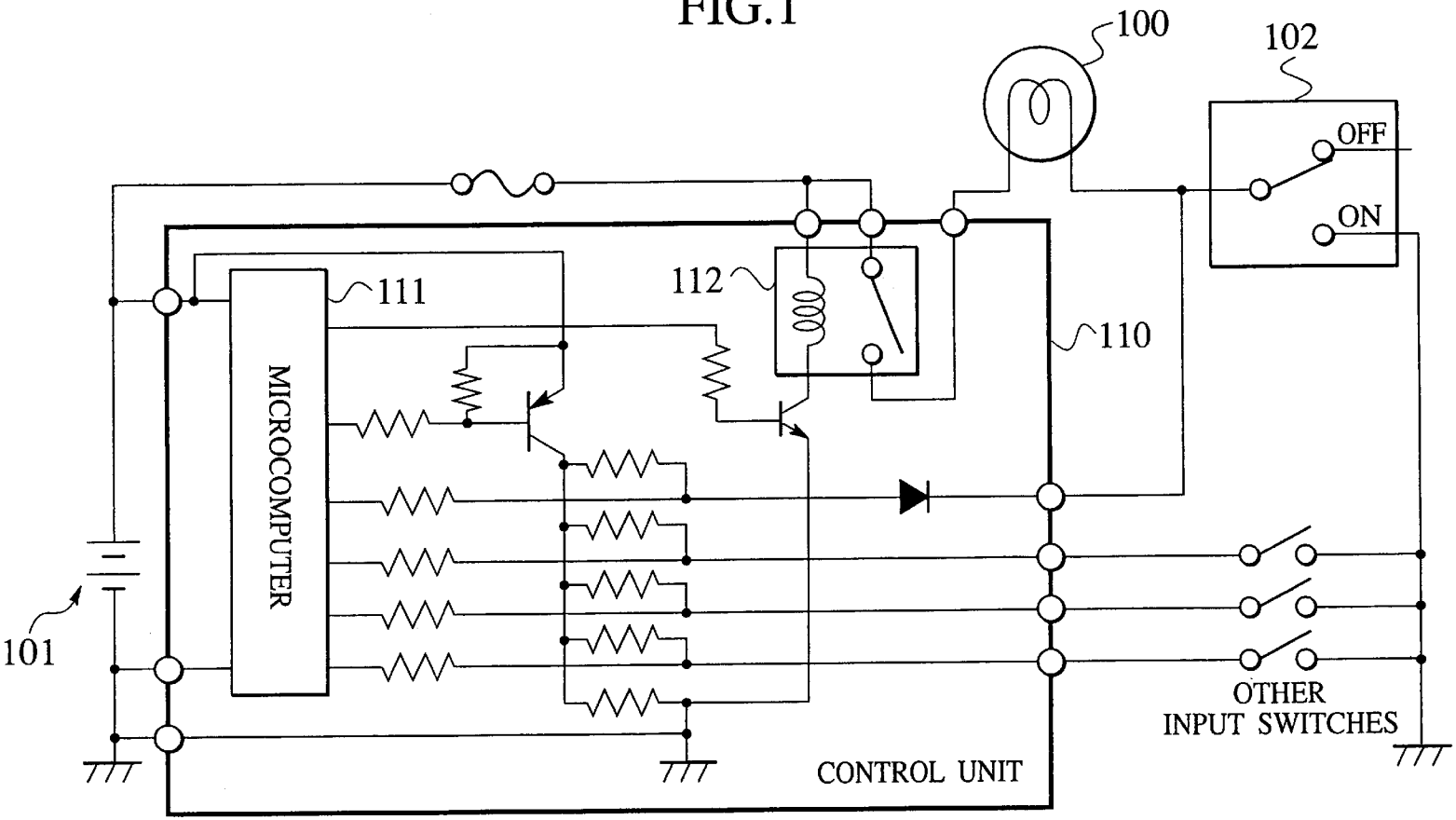
FIG.1 PRIOR ART
FIG. 1 is a circuit diagram showing a constitution of a conventional load drive circuit.
Figure 2:
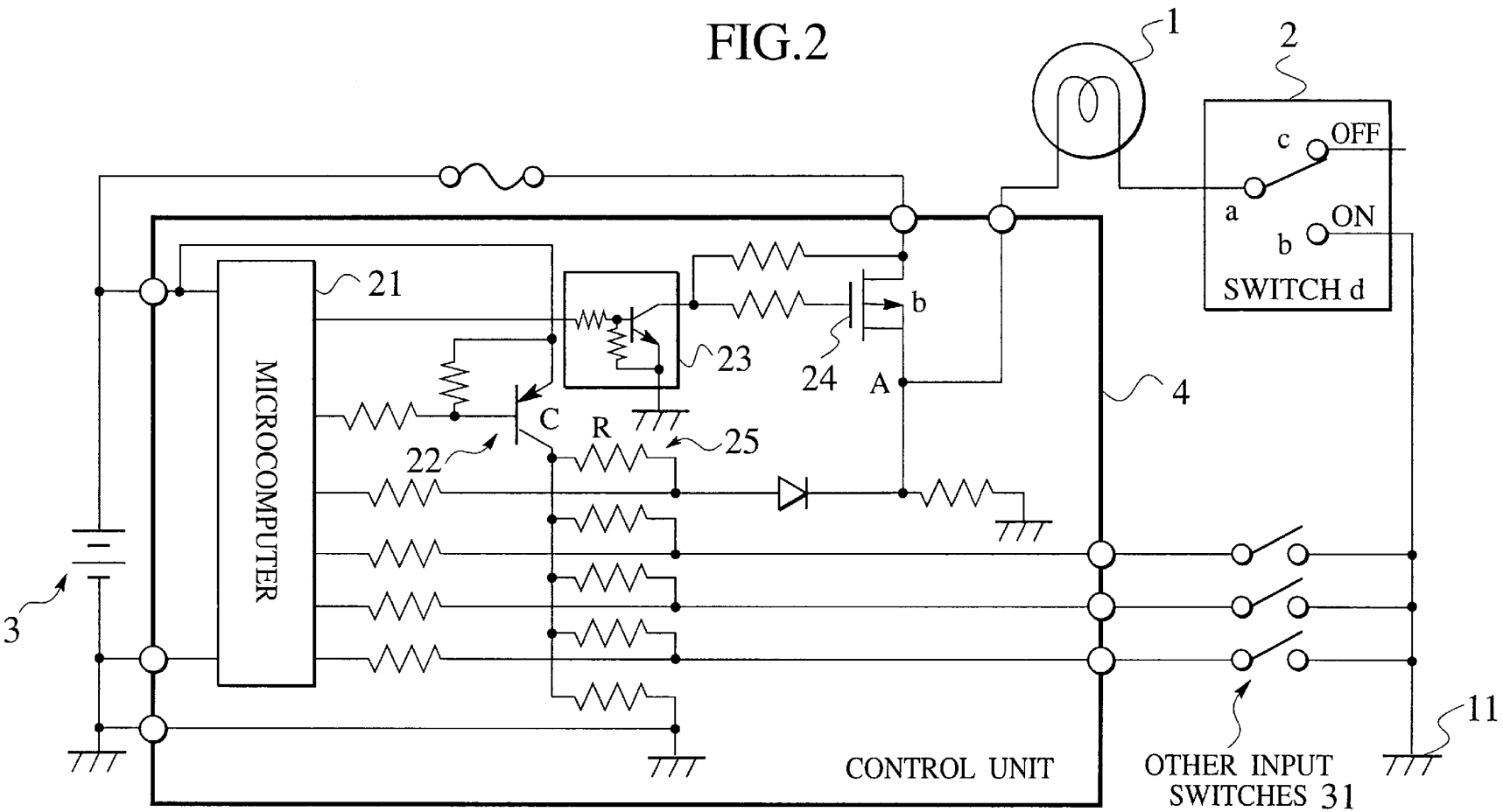
FIG. 2 is a circuit diagram showing a constitution of a load drive circuit according to the present invention.

The invention is applied to a load drive circuit constructed, for example, in a manner shown in FIG. 2.

[Constitution of Load Drive Circuit]

This load drive circuit comprises a lamp load 1 as a load circuit, a lamp switch 2 operated by a user to change an ON/OFF state of the lamp load 1, a power supply 3 for supplying a power supply voltage to the lamp load 1, and a control unit 4 for controlling driving of the lamp load 1.

In the load drive circuit, the lamp switch 2 is disposed on a downstream side of the power supply 3 of the lamp load 1, and operated to connect its terminals a and b with each other. Thus, the power supply 3 and a ground terminal 11 are connected to supply a power supply voltage to the lamp load 1. In addition, in the load drive circuit, the lamp switch 2 is operated to connect its terminals a and c with each other, and thus the power supply voltage of the power supply 3 is released by the terminal c.

The control unit 4 includes a microcomputer 21 for performing driving control and power supply management of the lamp load 1, a strobe circuit 22 as a switch circuit, a switching section 23, a MOSFET 24 as a semiconductor switching device, and a pull-up resistor 25 connected to the strobe circuit 22.

For the strobe circuit 22, the microcomputer 21 is connected to a base terminal, the power supply 3 is connected to a collector terminal, and an emitter terminal is grounded. This strobe circuit 22 is turned ON by supplying a monitor control signal from the microcomputer 21 to the base terminal. The strobe circuit 22 is kept ON only for a period T2 at each monitor cycle T1 for monitoring a state of the lamp switch 2 by the microcomputer 21.

For the switching section 23, the microcomputer 21 is connected to the base terminal, a collector terminal is connected to a gate terminal of the MOSFET 24, and the emitter terminal is grounded. This switching section 23 is turned ON by supplying a load driving control signal from the microcomputer 21 to the base terminal.

For the MOSFET 24, the switching section 23 is connected to the gate terminal, the power supply 3 is connected to a source terminal, and the lamp load 1 is connected to a drain terminal. Turning ON/OFF of this MOSFET 24 is controlled by the microcomputer 21. By being turned ON, the MOSFET 24 supplies the power supply voltage from the power supply 3 to the lamp load 1. The MOSFET 24 is kept ON only for a period where the lamp load 1 is lit (ON state).

The microcomputer 21 is connected to the power supply 3 to control supply of power to the lamp load 1, and performs the power supply management by monitoring the ON/OFF state of the lamp switch 2. The microcomputer 21 supplies a monitoring control signal for controlling the turning ON/OFF of the strobe circuit 22 to the base terminal of the strobe circuit 22, controls the turning ON/OFF of the switching section 23 to detect a potential at a node A by the pull-up resistor 25, and controls the turning ON/OFF of the MOSFET 24 to control the supply of power supply voltage to the lamp load 1.

[Operation of Load Drive Circuit]

FIGS. 3A to 3E are timing charts, each thereof showing an operation of the foregoing load drive circuit.

Figures 3A, 3B, 3C, 3D, 3E:
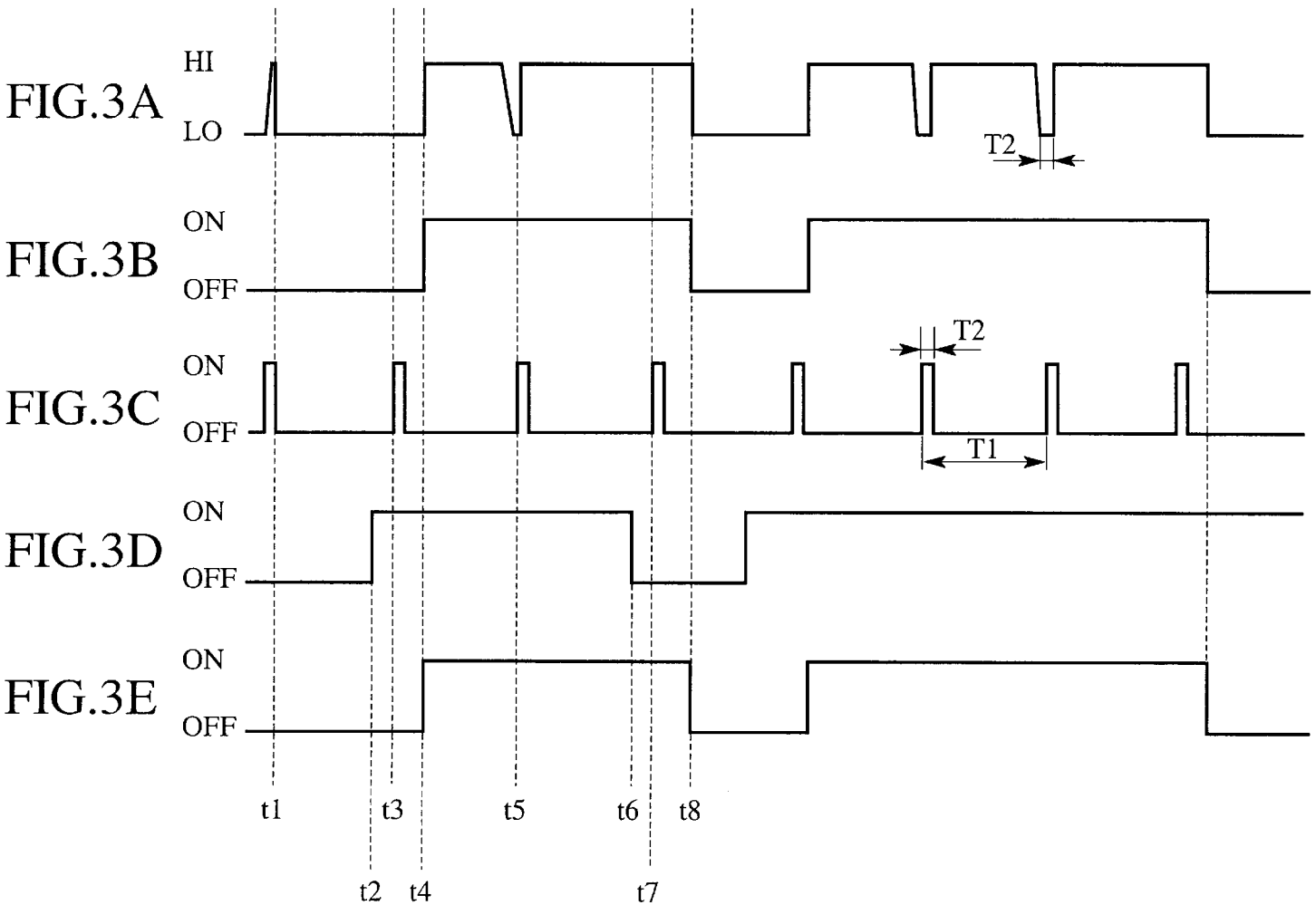
FIGS. 3A to 3E are timing charts, each thereof showing an operation of the load drive circuit of the invention.

As shown in FIGS. 3A to 3E, in order to monitor a state of the lamp switch 2, the microcomputer 21 outputs a monitoring control signal to the strobe circuit 22 at each monitor cycle T1 to turn it ON at each monitor cycle T1 (time t1 in FIG. 3C).

When the strobe circuit 22 is turned ON while the lamp switch 2 is in an OFF state (FIG. 3D), and the lamp load 1 is in a light-out (OFF) state (FIG. 3E), the presence of the pull-up resistor 25 causes a potential at the node A between the MOSFET 24 and the lamp load 1 to be set in a state HI. Accordingly, the microcomputer 21 recognizes the ON-state of the lamp switch 2, and no supply of power to the lamp load 1. Thus, in order to turn OFF the lamp load 1, the microcomputer 21 maintains the MOSFET 24 OFF.

Then, at time t2, the lamp switch 2 is turned ON (FIG. 3D). At subsequent time t3, the strobe circuit 22 is turned ON. If a potential at the node A is in a state LO (FIG. 3C), the microcomputer 21 recognizes that the lamp switch 2 has been turned ON.

At subsequent time t4, the microcomputer 21 supplies a load driving control signal to the switching section 23 to turn ON the MOSFET 24 (FIG. 3B), and supplies power supply voltage to the lamp load 1.

At subsequent time t5, if the strobe circuit 22 is in an ON state at the monitor cycle T1 (FIG. 3C), the microcomputer 21 recognizes that the potential at the node A has been set in a state LO (FIG. 3A), and the lamp switch 2 continues to be ON.

Then, at time t6, when the lamp switch 2 is turned OFF (FIG. 3D), the potential at the node A is set in a state HI when the strobe circuit 22 is turned ON at subsequent time t7 (FIG. 3C, and FIG. 3D). As a result, the microcomputer 21 recognizes that the lamp switch 2 is in an OFF state. By turning OFF the MOSFET 24 at time t8 (FIG. 3B), the microcomputer 21 turns OFF the lamp load 1 (FIG. 3E).

Here, the microcomputer 21 monitors the state of the lamp switch 2 by turning ON the strobe circuit 22. However, when the MOSFET 24 is ON, the potential at the node A is set in a state HI even if the lamp switch 2 is ON. On the other hand, the microcomputer 21 turns OFF the MOSFET 24 to monitor the state of the lamp switch 2 before turning ON the state of the strobe circuit 22, and then turns ON the MOSFET 24 again.

The foregoing operation causes momentary lighting-out of the lamp load 1, resulting in flickering. However, by using the microcomputer 21 to make an adjustment such that the period T2 where the MOSFET 24 is OFF can be sufficiently shorter compared with the monitor cycle T1, an unoperated period of the lamp load 1 can be shortened to one which a user can ignore, and flickering of the lamp load 1 is set to an invisible level.

In such a load drive circuit, by using the MOSFET 24 having a short ON/OFF time as a switching device for turning ON/OFF the lamp load 1, the state of the lamp switch 2 can be monitored irrespective of driving of the lamp load 1. Therefore, according to the load drive circuit of the invention, even if the lamp load 1 of a direct off switch system is provided, it is possible to achieve power supply management for monitoring forgotten turning-OFF or the like of the lamp switch 2.

In addition, according to the load drive circuit of the invention, the state of the lamp switch 2 can be monitored on the control unit 4 side, i.e., on the power supply voltage supply side, the circuit can be efficiently constructed, simplifying the circuitry. Also, according to the load drive circuit, since the necessity of providing another circuit outside the control unit 4 to monitor the state of the lamp switch 2 is eliminated, it is possible to reduce manufacturing costs.

Note that the foregoing embodiment is only an example of the invention. Thus, the invention is not limited to the embodiment. Apparently, various changes and modifications can be made according to design or the like without departing from the technical teachings of the invention.

That is, according to the load drive circuit, by use of the MOSFET 24 capable of achieving high-speed turning ON/OFF, the MOSFET 24 can be controlled by the microcomputer 21 to perform PWM control such as fadeout lighting-out (light reduction system) of the lamp load 1 or the like.

According to the load drive circuit, by using the MOSFET 24 capable of blocking heat, countermeasures can be taken against an overcurrent applied to the lamp load 1, and thus a commercial value of the circuit can be increased.

According to the load drive circuit of the invention, by sharing the strobe circuit 22 with the other input switches 31, the foregoing operation of the control unit 4 for reading the input switches 31 by a strobe system can be realized without any costs, thus providing an advantage similar to the above.

Furthermore, the load drive circuit has been described by way of example where the MOSFET 24 is used as a semiconductor switching device, and the transistor is used as a monitoring switch circuit. Needless to say, however, the foregoing advantages can be provided even if other high-speed switching devices are used.

What is claimed is:

1. A load drive circuit comprising:

a power supply;

a load circuit;

a load power supply switch configured to switch states between on and off, the load power supply switch being disposed on a downstream side of the power supply of the load circuit;

a controller configured to drive the load circuit by supplying a load driving control signal and to monitor the state of the load power supply switch by supplying a monitoring control signal;

a switching device connected to the load circuit for supplying a power supply voltage to the load circuit according to the load driving control signal;

a monitoring switch circuits configured to monitor the state of the load power supply switch and to switch states between on and off based on the duration of the monitoring control signal; and a monitoring resistor connected to the monitoring switch circuit, wherein the controller is configured to switch the state of the load circuit between on and off based on a voltage value of the monitoring resistor, and wherein the controller is configured to supply the load driving control signal to the switching device for a duration sufficiently shorter than the duration of the monitoring control signal supplied to the monitoring switch circuit.

2. A load drive circuit comprising:

a power supply;

a load circuit;

a load power supply switch disposed on a downstream side of said power supply of said load circuit;

a semiconductor switching device including a power supply terminal connected to said load circuit, and turned ON/OFF to supply a power supply voltage to said load circuit according to a load driving control signal;

a monitoring switch circuit turned ON/OFF according to a monitoring control signal of a timing for monitoring a state of said load power supply switch;

a monitoring resistor connected to said monitoring switch circuit; and a controller for driving said load circuit by supplying the load driving control signal to said semiconductor switching device to control turning ON/OFF, and monitoring the state of said load power supply switch by supplying the monitoring control signal to said monitoring switch circuit to control turning ON/OFF, based on a voltage value by said monitoring resistor, wherein said controller sets supply time of the load driving control signal supplied to said semiconductor switching device to be sufficiently shorter than supply time of the monitoring control signal supplied to said monitoring switch circuit.

3. The load drive circuit of claim 2, wherein the load circuit comprises a lamp load.

4. The load circuit of claim 2, wherein the semiconductor switching device comprises a MOSFET.

5. A load drive circuit comprising:

a power supply;

a load circuit;

a load power supply switch disposed on a downstream side of said power supply of said load circuit;

a semiconductor switching device including a power supply terminal connected to said load circuit, and turned ON/OFF to supply a power supply voltage to said load circuit according to a load driving control signal;

a monitoring switch circuit turned ON/OFF according to a monitoring control signal of a timing for monitoring a state of said load power supply switch;

a monitoring resistor connected to said monitoring switch circuit; and a controller for driving said load circuit by supplying the load driving control signal to said semiconductor switching device to control turning ON/OFF, and monitoring the state of said load power supply switch by supplying the monitoring control signal to said monitoring switch circuit to control turning ON/OFF, based on a voltage value by said monitoring resistor, wherein said controller turns OFF said semiconductor switching device, turns ON said monitoring switch circuit to monitor the state of said load power supply switch, and turns OFF said semiconductor switching device during driving of said load circuit.

6. The load drive circuit of claim 5, wherein the load circuit comprises a lamp load.

* * * * *